US009632481B2

(12) United States Patent
Suzuki

(10) Patent No.: US 9,632,481 B2
(45) Date of Patent: Apr. 25, 2017

(54) IMAGE FORMING APPARATUS

(71) Applicant: CANON KABUSHIKI KAISHA, Tokyo (JP)

(72) Inventor: Tetsuji Suzuki, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 19 days.

(21) Appl. No.: 14/711,896

(22) Filed: May 14, 2015

(65) Prior Publication Data

US 2015/0241842 A1 Aug. 27, 2015

Related U.S. Application Data

(63) Continuation of application No. 14/080,888, filed on Nov. 15, 2013, now Pat. No. 9,063,514.

(30) Foreign Application Priority Data

Nov. 20, 2012 (JP) ..... 2012-253823
Nov. 12, 2013 (JP) ..... 2013-233596

(51) Int. Cl.
*G03G 21/20* (2006.01)
*G03G 15/01* (2006.01)
*G03G 15/00* (2006.01)

(52) U.S. Cl.
CPC ..... *G03G 21/206* (2013.01); *G03G 15/0189* (2013.01); *G03G 15/50* (2013.01); *G03G 21/20* (2013.01)

(58) Field of Classification Search
CPC ..... G03G 21/20; G03G 21/206
See application file for complete search history.

(56) References Cited

U.S. PATENT DOCUMENTS 5,146,279 A 9/1992 Seyfried
9,063,514 B2 * 6/2015 Suzuki ..... G03G 15/0189
2006/0104657 A1 5/2006 Mori
(Continued)

FOREIGN PATENT DOCUMENTS

JP H05-216340 A 8/1993
JP 2003-208065 A 7/2003
(Continued)

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

The image forming apparatus includes a cooling device for cooling a plurality of cartridges, and a plurality of shielding members for shielding the plurality of openings, respectively. Each developing member is movable between a first position at which the developing member is brought into contact with a photosensitive member and a second position at which the developing member is caused to separate from the photosensitive member. Each of the plurality of shielding members is caused to move in association with a position of the developing member of the cartridge opposed to the opening to be shielded by the each of the shielding members. A gap between the opening and the shielding member the second position of the developing member is smaller than a gap therebetween at the first position of the developing member is.

8 Claims, 8 Drawing Sheets

(56) References Cited

U.S. PATENT DOCUMENTS

| | | | | |
|---|---|---|---|---|
| 2007/0177899 | A1* | 8/2007 | Kawamura | G03G 15/0121 399/223 |
| 2009/0311017 | A1 | 12/2009 | Ohmori et al. | |
| 2010/0092193 | A1 | 4/2010 | Fujimori et al. | |
| 2011/0170883 | A1 | 7/2011 | Suzuki | |
| 2011/0280609 | A1* | 11/2011 | Nakazawa | G03G 21/206 399/92 |
| 2012/0128386 | A1 | 5/2012 | Katayama et al. | |

FOREIGN PATENT DOCUMENTS

| | | | |
|---|---|---|---|
| JP | 2004-233452 | A | 8/2004 |
| JP | 2005-326540 | A | 11/2005 |
| JP | 2011-227254 | A | 11/2011 |

* cited by examiner

IMAGE FORMING APPARATUS

This application is a continuation of application Ser. No. 14/080,888, filed Nov. 15, 2013.

BACKGROUND OF THE INVENTION

Field of the Invention

The present invention relates to an image forming apparatus for forming an image on a recording material.

Description of the Related Art

Conventionally, in some image forming apparatus, an image is formed through use of electrophotography involving electrostatically controlling and attracting a developer (toner) formed of micropowder. The toner has property of being melted with heat, and hence it is necessary to take an increase in temperature in the image forming apparatus that is caused along with the operation of the image forming apparatus into consideration.

In particular, an apparatus main body has been downsized in recent years, resulting in a smaller relative distance between an image forming portion (process cartridge) containing a toner and electrical components such as a heat-fixing device, a motor, and an electric circuit board serving as heat-generation sources. Further, due to an increase in output speed of the image forming apparatus, rubbing between a photosensitive drum in the process cartridge and a drum cleaning blade or a developing roller has also become unignorable as the heat-generation sources. Therefore, it becomes still more essential to consider a change in temperature in the apparatus main body.

In order to solve the above-mentioned problem, the periphery of the process cartridge is kept at certain temperature or lower by introducing cooling air into the image forming apparatus through use of a cooling fan and appropriately arranging a duct serving as an air flow path.

Japanese Patent Application Laid-Open No. 2004-233452 proposes a configuration in which heat from a fixing portion is prevented from being transmitted to an image bearing member or an image forming portion.

Further, Japanese Patent Application Laid-Open No. 2005-326540 discloses a configuration in which, in order to keep, at a certain level or less, an increase in temperature in an image forming apparatus that is caused by the continuous operation of the image forming apparatus, for example, the heat generation amount is suppressed by increasing a sheet interval during continuous printing or switching the continuous operation to an intermittent operation involving suspension repeatedly to cool a heat-generation portion during suspension.

However, in recent years, there has been an increasing demand for lower noise in the image forming apparatus. Therefore, it is necessary to decrease the r.p.m. of the cooling fan. Thus, there arises a problem in that an air amount cannot be ensured sufficiently. Further, the downsizing of the apparatus main body and the increase in output speed have advanced. Therefore, it is also difficult to sufficiently ensure a clearance between the image forming portion and the heat-generation source and to decrease the throughput (processing performance per unit time) of a recording operation.

Further, in a color image forming apparatus, different printing speeds are set for color printing and monochrome printing in most cases. In particular, there is a demand for a further increase in output speed during monochrome printing. However, conventionally, common thermal design has been used for monochrome printing and color printing.

Therefore, in some cases, cooling of the image forming apparatus during monochrome printing is not sufficient. In this case, under severe conditions such as image formation in a high-temperature environment and continuous image formation of forming a great amount of images at a time, the periphery of the process cartridge cannot be kept at predetermined temperature or lower in some cases.

SUMMARY OF THE INVENTION

An object of the present invention is to appropriately cool an image forming apparatus by providing an efficient air flow path.

Another object of the present invention is to provide the following image forming apparatus.

A further purpose of the present invention is to provide an image forming apparatus, comprising a plurality of cartridges, each of which comprises a photosensitive member having a surface on which a latent image is formed, and a developing member for supplying a toner to the latent image formed on the surface of the photosensitive member, a cooling device for cooling the plurality of cartridges by flowing air through a plurality of openings, each of which is provided to be opposed to each of the plurality of cartridges, and a plurality of shielding members, each of which shields each of the plurality of openings, wherein in the each of the plurality of cartridges, the developing member is movable between a first position at which the developing member contacts with the photosensitive member and a second position at which the developing member separates from the photosensitive member, wherein each of the plurality of shielding members moves in association with a position of the developing member of corresponding one of the plurality of cartridges, the position opposed to corresponding one of the plurality of openings to be shielded by the each of the plurality of shielding members, and wherein a gap between the each of the plurality of openings and the each of the plurality of shielding members when the developing member is at the second position is smaller than a gap between the each of the plurality of openings and the each of the plurality of shielding members when the developing member is at the first position.

A still further feature of the present invention will become apparent from the following description of exemplary embodiments with reference to the attached drawings.

DESCRIPTION OF THE EMBODIMENTS

Figure 1:
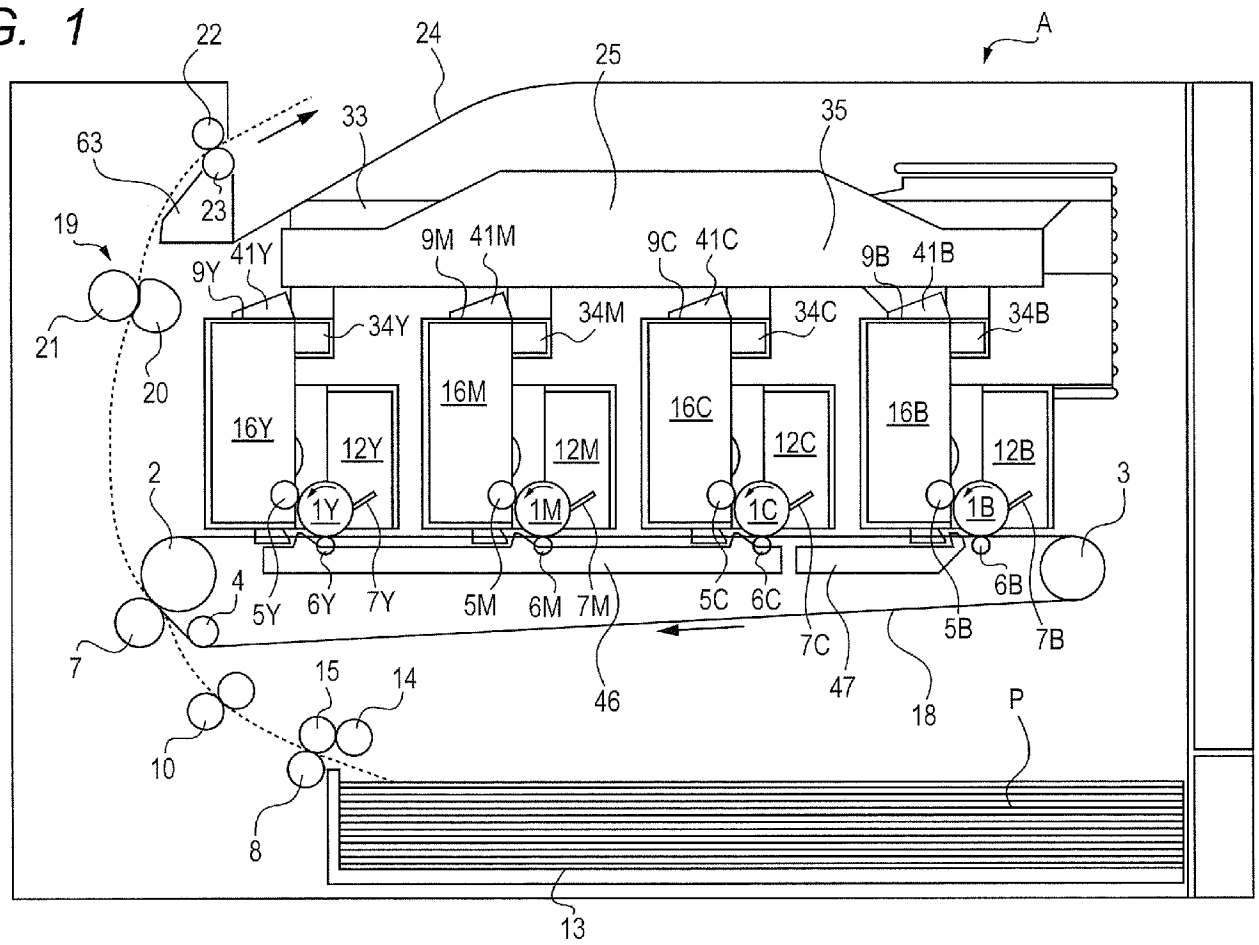
FIG. 1 is an explanatory sectional view illustrating a configuration of an image forming apparatus according to a first embodiment of the present invention.

Referring to the drawings, an image forming apparatus according to embodiments of the present invention is described in detail. Note that, sizes, materials, shapes, and relative arrangements of components described in each embodiment may be altered appropriately depending on the configuration and various conditions of an apparatus to which the present invention is applied, and the scope of the present invention is not limited to the following embodiments.

First Embodiment

First, a configuration of an image forming apparatus according to a first embodiment of the present invention is described with reference to FIGS. 1 to 5. In this embodiment, the case where an image forming apparatus A is applied to a full-color laser beam printer as an example is described. Note that, the image forming apparatus A can also be applied to image forming apparatus other than a printer, such as a copier and a facsimile.

<Image Forming Apparatus>

First, a schematic configuration of the image forming apparatus A is described with reference to FIG. 1. FIG. 1 is a sectional view illustrating a schematic configuration of the image forming apparatus A according to the first embodiment.

As illustrated in FIG. 1, the image forming apparatus A includes, in a main body thereof, a feed tray 13 for receiving recording materials P such as sheets in a stacked manner. Further, the image forming apparatus A includes a pickup roller 14 and a feed roller 15 forming a feed portion. Further, the image forming apparatus A includes an intermediate transfer belt 18 tensioned by tensioning rollers 2 to 4. Further, the image forming apparatus A includes a fixing film 20 and a pressure roller 21 forming a fixing device 19 serving as fixing means for fixing the recording material P with a toner image transferred thereto by heating and pressurizing the recording material P. Further, a laser scanner 25 and the like are provided in the image forming apparatus A.

A plurality of process cartridges 9Y, 9M, 9C, and 9B are provided so as to correspond to respective colors: yellow (Y), magenta (M), cyan (C), and black (B).

Note that, for convenience of description, the respective process cartridges 9Y, 9M, 9C, and 9B are represented by a process cartridge 9 in some cases. The same applies to components forming the other respective image forming units.

The process cartridges 9 include photosensitive drums 1Y, 1M, 1C, and 1B serving as image bearing members in which an electrostatic latent image is formed on a surface uniformly charged by charging means (not shown). Further, the process cartridges 9 include developing rollers 5Y, 5M, 5C, and 5B serving as rotary developing members for supplying a toner to an electrostatic latent image formed on the surface of the photosensitive drum 1. Further, the process cartridges 9 include cleaning blades 7Y, 7M, 7C, and 7B serving as cleaning members for removing a toner by being brought into contact with the surface of the photosensitive drum 1.

The respective process cartridges 9 include cleaning units 12Y, 12M, 12C, and 12B in each of which the photosensitive drum 1 and the cleaning blade 7 are provided, and developing units 16Y, 16M, 16C, and 16B in each of which the developing roller 5 is provided. Then, the developing unit 16 is provided so as to rotate with respect to each cleaning unit 12 about a rotation center (not shown) thereof.

Each process cartridge 9 is removably held in a cartridge tray (not shown) provided in the main body of the image forming apparatus A and is mounted in a mounting portion provided at a predetermined position in the main body of the image forming apparatus A.

Primary transfer rollers 6Y, 6M, 6C, and 6B serving as primary transfer means are provided at positions on an inner circumferential surface side of the intermediate transfer belt 18 so as to be opposed to the respective photosensitive drums 1. The primary transfer rollers 6Y, 6M, and 6C are provided so as to be brought into contact with or caused to separate from the respective photosensitive drums 1Y, 1M, and 1C through intermediation of the intermediate transfer belt 18 by being engaged with a separating lever (not shown) which is moved in a horizontal direction of FIG. 1 by movement means including a cam mechanism (not shown) and the like. Further, the primary transfer roller 6B is provided so as to be brought into contact with or caused to separate from the photosensitive drum 1B through intermediation of the intermediate transfer belt 18 by being engaged with a separating lever (not shown) which is moved in the horizontal direction of FIG. 1 by movement means including a cam mechanism (not shown) and the like.

There is provided a secondary transfer roller 7 serving as secondary transfer means which is brought into contact, through intermediation of the intermediate transfer belt 18, with the tensioning roller 2 for tensioning the intermediate transfer belt 18 so as to be opposed to the tensioning roller 2.

The photosensitive drum 1 rotates in a counterclockwise direction of FIG. 1, and an outer circumferential surface of the photosensitive drum 1 is uniformly charged by the charging means (not shown). Then, the photosensitive drum 1 is irradiated with laser light in accordance with image information from the laser scanner 25, with the result that electrostatic latent images are formed successively. Then, the developing roller 5 supplies a toner to each electrostatic latent image while rotating in contact with the surface of the photosensitive drum 1, and the electrostatic latent image is developed. In this manner, a toner image is formed.

The toner images formed on the surfaces of the respective photosensitive drums 1 are primarily transferred successively from the photosensitive drums 1 to the intermediate transfer belt 18 due to the function of the primary transfer rollers 6.

The toner remaining on the surface of each photosensitive drum 1 after primary transfer is scraped off by each cleaning blade 7 to be removed from the surface.

On the other hand, the recording materials P received in a stacked manner in the feed tray 13 are fed by the pickup roller 14 and the feed roller 15 which rotate in a clockwise direction of FIG. 1. Then, the recording materials P are separated from each other by a retard roller 8 which rotates in the clockwise direction of FIG. 1, and are fed on a one-by-one basis. After that, the recording material P is aligned with the toner images primarily transferred onto an outer circumferential surface of the intermediate transfer belt 18 by registration rollers 10, and is fed to a nip portion between the intermediate transfer belt 18 and the secondary transfer roller 7.

Then, the toner images which have been primarily transferred successively to the outer circumferential surface of the intermediate transfer belt 18 are secondarily transferred to the recording material P at a time due to the function of the secondary transfer roller 7.

The recording material P with the toner images transferred thereto is fed to a nip portion between the fixing film 20 and the pressure roller 21 provided in the fixing device 19. In the fixing device 19, the recording material P is heated and pressurized, with the result that the toner images are fixed to the recording material P. The recording material P with the toner images fixed thereto is discharged onto a discharging tray 24 while being nipped between a discharging roller 22 and a rotary discharging member 23 which form a discharging unit. The rotary discharging member 23 is rotatably provided at a discharging guide 63.

<Configuration of Cooling Portion>

Figure 2:
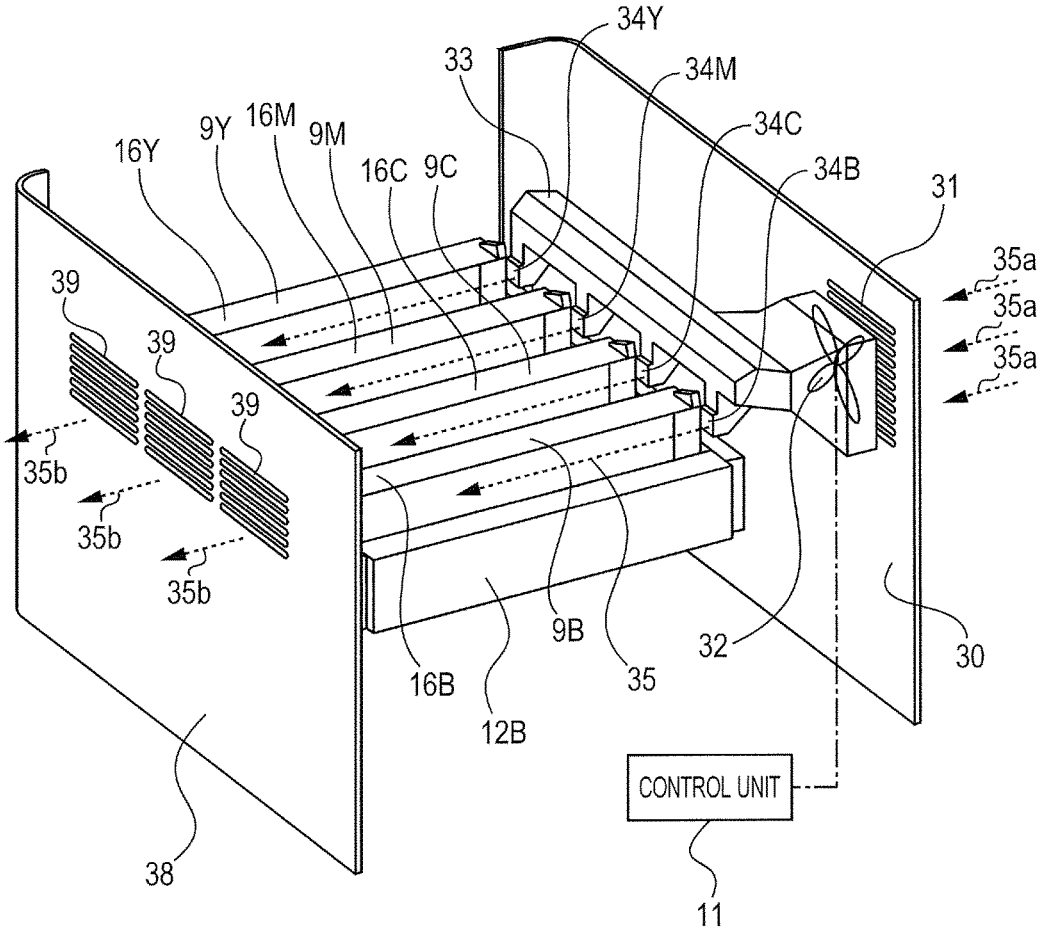
FIG. 2 is an explanatory perspective view illustrating a path of cooling air during color printing in the first embodiment of the present invention.

Next, a configuration of a cooling portion of each process cartridge 9 is described with reference to FIG. 2. FIG. 2 is a perspective view illustrating a configuration of the cooling portion according to the first embodiment.

As illustrated in FIG. 2, the image forming apparatus A according to the first embodiment includes, as a component of the cooling portion, an inlet louver 31 formed of ventilation holes provided at a right cover 30 serving as an outer cover of the main body of the image forming apparatus A. Further, the cooling portion includes a cooling fan 32 serving as air flow means, an air flow duct 33 connected to the cooling fan 32, and outlet louvers 39 formed of ventilation holes provided at a left cover 38 serving as an outer cover of the main body of the image forming apparatus A.

The cooling fan 32 of the first embodiment is disposed in the vicinity of the inlet louver 31 in the air flow duct 33. Further, the air flow duct 33 has openings 34Y, 34M, 34C, and 34B arranged in the vicinity of respective ends on one side in a longitudinal direction of the process cartridges 9Y, 9M, 9C, and 9B. The openings 34Y, 34M, 34C, and 34B are respectively arranged to be opposed to the corresponding process cartridges 9Y, 9M, 9C, and 9B.

The cooling fan 32 is controlled to rotate by a control unit 11 serving as control means. Air 35*a* drawn by the cooling fan 32 from outside of the main body of the image forming apparatus A through the inlet louver 31 is caused to flow to the air flow duct 33 as cooling air 35. Then, the cooling air 35 is caused to flow from the respective openings 34Y, 34M, 34C, and 34B provided in the air flow duct 33 to the ends on one side in the longitudinal direction of the respective process cartridges 9Y, 9M, 9C, and 9B.

Then, the cooling air 35 is caused to flow in the longitudinal direction from ends on one side in the longitudinal direction of the photosensitive drums 1Y, 1M, 1C, and 1B in the process cartridges 9Y, 9M, 9C, and 9B to ends on the other side of the photosensitive drums 1Y, 1M, 1C, and 1B. Thus, the peripheries of the photosensitive drums 1Y, 1M, 1C, and 1B are cooled. Air 35*b* having passed through the ends on the other side of the process cartridges 9Y, 9M, 9C, and 9B is then discharged outside of the main body of the image forming apparatus A through the outlet louvers 39.

<Adjustment of Air Amount to Process Cartridge>

Figure 3:
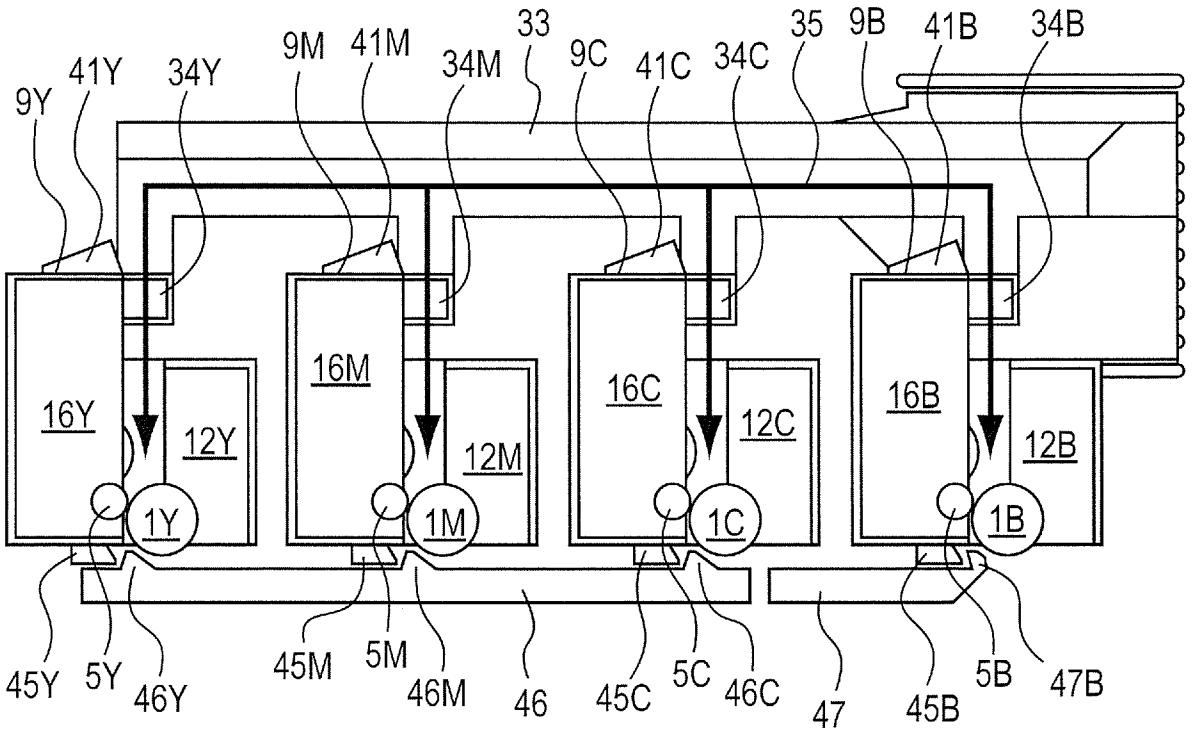
FIG. 3 is an explanatory sectional view illustrating the path of the cooling air during color printing in the first embodiment of the present invention.
Figure 4:
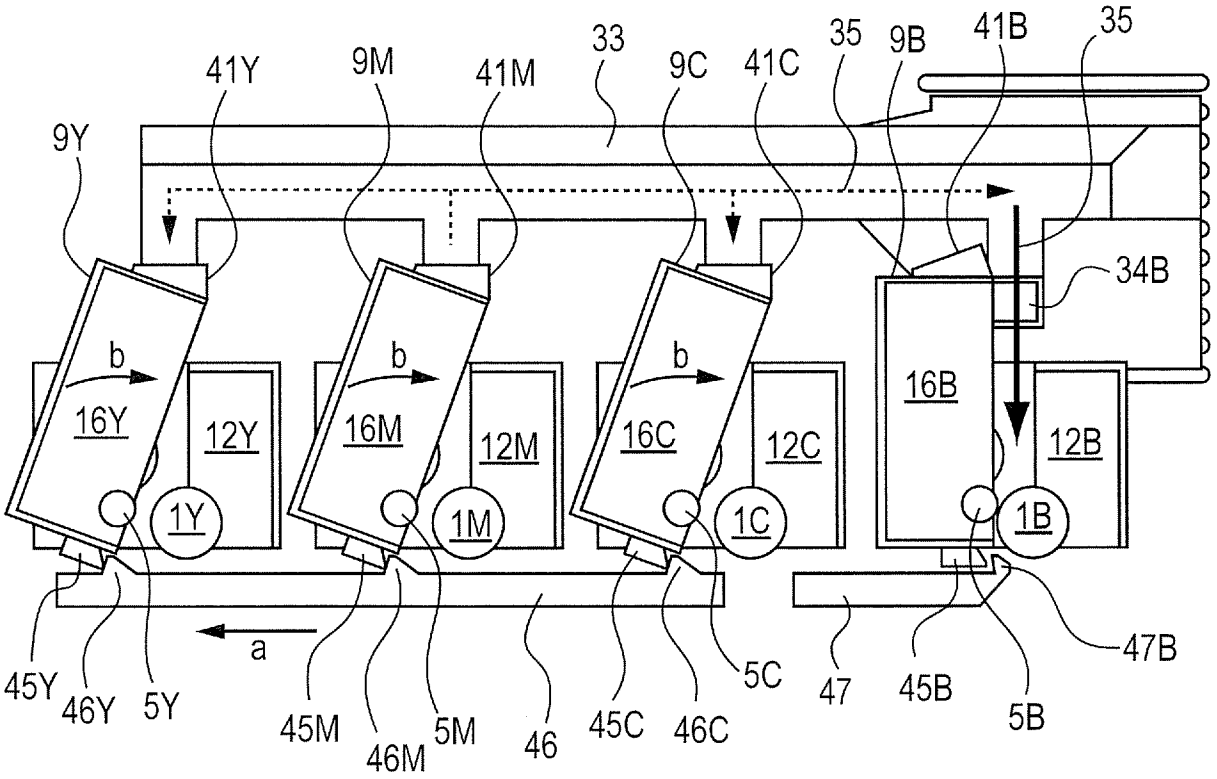
FIG. 4 is an explanatory sectional view illustrating a path of cooling air during monochrome printing in the first embodiment of the present invention.

Next, a method of adjusting the air amount of the cooling air 35 to be caused to flow to the respective process cartridges 9Y, 9M, 9C, and 9B during color printing (first mode) illustrated in FIG. 3 and during monochrome printing (second mode) illustrated in FIG. 4 is described. FIG. 3 is an explanatory sectional view illustrating a configuration of the cooling portion during color printing in the first embodiment, and FIG. 4 is an explanatory sectional view illustrating a configuration of the cooling portion during monochrome printing.

As illustrated in FIGS. 3 and 4, the developing units 16 of the process cartridges 9 of the first embodiment include shielding portions 41Y, 41M, 41C, and 41B serving as shielding means (shielding members). Each of the shielding portions 41Y, 41M, 41C, and 41B is part of a housing of the developing unit 16. The shielding portion 41 shields the corresponding opening 34 of the air flow duct 33 in synchronization with the rotation operation of each developing unit 16 which is rotated by separating levers 46 and 47 serving as contacting/separating means.

Note that, the separating levers 46 and 47 are each provided so as to move in the horizontal direction illustrated in FIGS. 1, 3, and 4 by movement means including a cam mechanism (not shown) and the like. The separating levers 46 and 47 are constructed as contacting/separating means capable of switching between a first state in which the photosensitive drum 1 and the developing roller 5 are brought into contact with each other as illustrated in FIG. 3 and a second state in which the photosensitive drum 1 and the developing roller 5 are caused to separate from each other as illustrated in FIG. 4. That is, the developing roller 5 can move, by the contacting/separating means, between a first position at which the developing roller 5 is brought into contact with the photosensitive drum 1 and a second position at which the developing roller 5 is caused to separate from the photosensitive drum 1.

Figure 5:
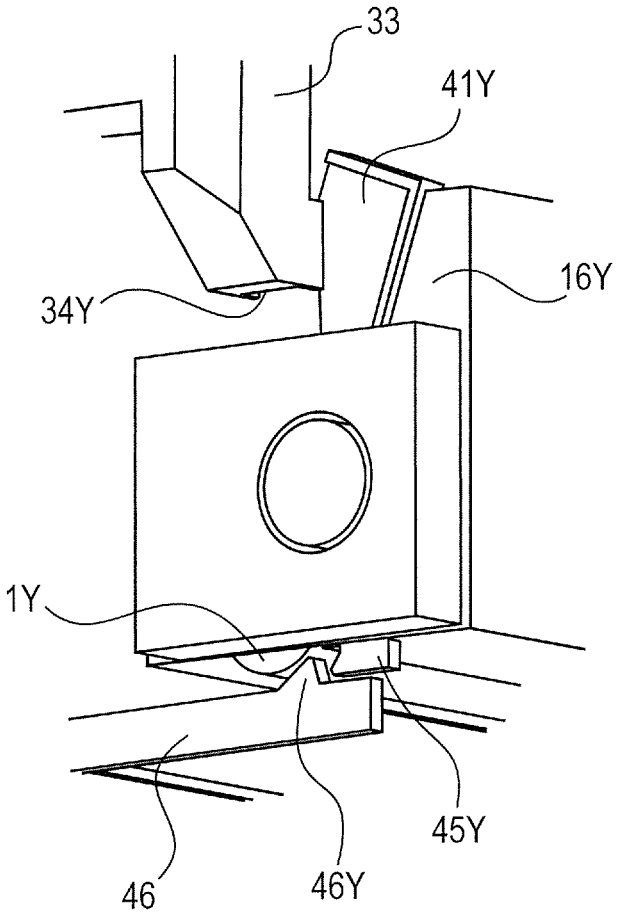
FIG. 5 is an explanatory perspective view illustrating an arrangement configuration of an opening of an air flow duct, shielding means for shielding the opening, and contacting/separating means for an image bearing member and a rotary developing member, which are provided in the vicinity of a process cartridge, in the first embodiment of the present invention.

As illustrated in FIG. 5, the shielding portions 41 of the first embodiment are provided at positions corresponding to the openings 34 of the air flow duct 33 at the ends on one side in the longitudinal direction of the respective process cartridges 9 and respectively have an area capable of completely covering at least the openings 34.

As illustrated in FIG. 4, the shielding portion 41 is provided in a portion capable of moving integrally with the developing roller 5 when the developing roller 5 is caused to separate from the photosensitive drum 1.

The developing units 16 respectively include engagement portions 45Y, 45M, 45C, and 45B. On the other hand, the separating lever 46 for color printing provided on the main body side of the image forming apparatus A includes engagement portions 46Y, 46M, and 46C. Further, the separating lever 47 for monochrome printing includes an engagement portion 47B. Then, the engagement portions 45Y, 45M, 45C, and 45B are arranged so as to be engaged with the engagement portions 46Y, 46M, 46C, and 47B.

On the main body side of the image forming apparatus A, there is provided the movement means including the cam mechanism (not shown) and the like for moving each of the separating lever 46 for color printing and the separating lever 47 for monochrome printing in the horizontal direction of FIGS. 3 and 4.

FIG. 5 illustrates the shielding portion 41Y which is provided at the developing unit 16Y of the process cartridge 9Y of yellow (Y) color and which rotates integrally with the rotation operation of the developing unit 16Y. Further, FIG. 5 illustrates the opening 34Y of the air flow duct 33 to be closed by the shielding portion 41Y. Further, FIG. 5 illustrates the engagement portion 45Y provided at the developing unit 16Y. Further, FIG. 5 is an enlarged perspective view illustrating an arrangement configuration of the engagement portion 46Y of the separating lever 46 to be engaged with the engagement portion 45Y.

The shielding portion 41 of the first embodiment is provided at each developing unit 16. Alternatively, the shielding portion 41 may be provided on the main body side of the image forming apparatus A as long as the shielding portion 41 is operated in synchronization with the operation in which the developing roller 5 is caused to separate from the photosensitive drum 1.

When color printing illustrated in FIG. 3 is switched to monochrome printing illustrated in FIG. 4, the separating lever 46 for color printing is moved in a direction of an arrow "a" of FIG. 4 by the movement means including the cam mechanism (not shown) and the like. In this case, the engagement portions 46Y, 46M, and 46C provided at the separating lever 46 are engaged with the engagement portions 45Y, 45M, and 45C of the respective developing units 16Y, 16M, and 16C. Then, the developing units 16Y, 16M, and 16C are rotated in a direction of an arrow "b" of FIG. 4 about the rotation center (not shown) thereof.

As a result, the photosensitive drums 1Y, 1M, and 1C of the process cartridges 9Y, 9M, and 9C are caused to separate from the developing rollers 5Y, 5M, and 5C. In synchronization with this separating operation, the shielding portions 41Y, 41M, and 41C provided at the developing units 16Y, 16M, and 16C move to positions of shielding the openings 34Y, 34M, and 34C of the air flow duct 33 to close the openings 34Y, 34M, and 34C.

As illustrated in FIG. 3, the opening area of each of the openings 34Y, 34M, and 34C in the second state in which the photosensitive drum 1 and the developing roller 5 are caused to separate from each other as illustrated in FIG. 4 becomes smaller than that in the first state in which the photosensitive drum 1 and the developing roller 5 are brought into contact with each other. Thus, the shielding portions 41Y, 41M, and 41C shield the respective openings 34Y, 34M, and 34C of the air flow duct 33.

Further, during monochrome printing, when the primary transfer rollers 6Y, 6M, and 6C retract from the photosensitive drums 1Y, 1M, and 1C, the intermediate transfer belt 18 is caused to separate from the photosensitive drums 1Y, 1M, and 1C. Then, the photosensitive drums 1Y, 1M, and 1C stop rotating.

<Cooling Function>

During color printing illustrated in FIG. 3, the cooling air 35 flowing from the air flow duct 33 is substantially uniformly blown to the peripheries of the photosensitive drums 1Y, 1M, 1C, and 1B of the process cartridges 9Y, 9M, 9C, and 9B through the openings 34Y, 34M, 34C, and 34B.

In contrast, during monochrome printing illustrated in FIG. 4, the openings 34Y, 34M, and 34C opposed to the process cartridges 9Y, 9M, and 9C of yellow (Y), magenta (M), and cyan (C) are respectively shielded completely by the shielding portions 41Y, 41M, and 41C. On the other hand, the opening 34B opposed to the process cartridge 9B of black (B) is at a position from which the shielding portion 41B is retracted, and hence the opening 34B is fully opened. Therefore, the cooling air 35 flowing from the air flow duct 33 is concentrated in the opening 34B opposed to the process cartridge 9B of black (B). Thus, the cooling air 35 can be concentratedly blown to the periphery of the photosensitive drum 1B of the process cartridge 9B of black (B). That is, a resistance to the flowing air is increased in the vicinity of the shielded openings 34Y, 34M, and 34C by shielding the openings 34Y, 34M, and 34C without shielding the opening 34B, and hence the air flows to the unshielded opening 34B having a small resistance.

That is, in the first embodiment, during monochrome printing illustrated in FIG. 4, the opening area of the opening 34 to be shielded by the shielding portion 41 varies depending on the process cartridge 9.

In the case of using the configuration of the cooling portion of the first embodiment, for example, the r.p.m. of the cooling fan 32 during monochrome printing can be reduced by the control unit 11. For example, the following cases are described on the assumption that: the air amounts of the cooling air which needs to flow to the peripheries of the process cartridges 9Y, 9M, 9C, and 9B during color printing (printing speed P1 [ppm]) are 1 $m^3$/sec, respectively; and the air amount of the cooling air which needs to flow to the periphery of the process cartridge 9B of black (B) during monochrome printing (printing speed P2 [ppm], P2>P1) is twice the air amount during color printing (i.e., 2 $m^3$/sec). Note that, the printing speed refers to the number of printing pages per unit time and can also be referred to as "image formation speed".

Note that, in the case where the printing speed is set to be high for monochrome printing compared to that for color printing, the rotation speed of the photosensitive drum 1B in the process cartridge 9B of black (B) during monochrome printing becomes higher than that during color printing. Thus, the temperature elevation of the photosensitive drum 1B itself due to friction heat between the rotating photosensitive drum 1B and the cleaning blade 7B becomes more significant.

The conventional image forming apparatus does not have a duct and the like capable of selecting an object to which the cooling air is caused to flow from the cooling fan 32. That is, in the conventional image forming apparatus, the cooling air is caused to flow to the respective process cartridges 9Y, 9M, 9C, and 9B similarly during monochrome printing and during color printing. Therefore, the cooling fan 32 needs an output for obtaining the cooling air 35 of 4 $m^3$/sec (1 [$m^3$/sec]*4) so as to cause the cooling air 35 to flow in an air amount of 1 $m^3$/sec to the four process cartridges 9 during color printing. On the other hand, during monochrome printing, it is appropriate that the cooling air 35 is caused to flow in an air amount of 2 $m^3$/sec at least to the process cartridge 9B. However, assuming that the cooling air 35 leaks from the openings 34Y, 34M, and 34C because the cooling air 35 cannot be caused to flow concentratedly only to the process cartridge 9B, the cooling fan 32 needs an output for obtaining the cooling air 35 in an air amount of 8 $m^3$/sec (2 [$m^3$/sec]*4). Thus, the output (for example, the r.p.m.) of the cooling fan 32 during monochrome printing needs to be higher than that during color printing.

In the image forming apparatus A of the first embodiment, on the other hand, an output for obtaining the cooling air 35 of 4 $m^3$/sec is needed so that the cooling air 35 can be caused to flow in an air amount of 1 $m^3$/sec to the four process cartridges 9 during color printing illustrated in FIG. 3 in the same way as in the conventional image forming apparatus. However, during monochrome printing illustrated in FIG. 4, the cooling air 35 can be caused to flow concentratedly to the opening 34B of the process cartridge 9B without allowing the cooling air 35 to leak from the openings 34Y, 34M, and 34C. Therefore, it is appropriate that the cooling fan 32 has an output for obtaining the cooling air 35 in an air amount of 2 $m^3$/sec. Consequently, the output (for example, the r.p.m.) of the cooling fan 32 during monochrome printing can be decreased compared to that during color printing.

Accordingly, during color printing illustrated in FIG. 3, the cooling air 35 can be caused to flow from the cooling fan 32 to the peripheries of the respective process cartridges 9 of yellow (Y), magenta (M), cyan (C), and black (B).

Further, during monochrome printing illustrated in FIG. 4, the cooling air 35 flowing to the peripheries of the respective process cartridges 9 of yellow (Y), magenta (M), and cyan (C) is blocked. Then, the cooling air 35 can be caused to flow concentratedly from the cooling fan 32 to the periphery of the process cartridge 9 of black (B). Thus, even in the case where the printing speed during monochrome printing is higher than that during color printing, the r.p.m. of the cooling fan 32 can be suppressed, resulting in reduction in noise and power consumption.

Note that, the description on the air amount has been given assuming the case where the printing speed during monochrome printing is higher than that during color printing, but the present invention is not limited thereto. That is, it is apparent that, even when the printing speed during color printing is the same as that during monochrome printing, the output of the cooling fan 32 during monochrome printing can be set to be lower than that during color printing with the configuration of the image forming apparatus A of the first embodiment.

Thus, according to the first embodiment, the shielded state of the opening 34 of the air flow duct 33 can be varied depending on the position of each developing unit 16. Therefore, the process cartridge 9 can be cooled with the periphery of the process cartridge 9 kept at predetermined temperature or lower while achieving the high printing speed of the image forming apparatus A, and the reduction in noise and power consumption of the image forming apparatus A during monochrome printing.

Further, in the first embodiment, the shielding portions 41Y, 41M, and 41C for shielding the openings 34Y, 34M, and 34C are operated in synchronization with the separating operation between the photosensitive drums 1Y, 1M, and 1C and the developing rollers 5Y, 5M, and 5C. Thus, it is not necessary to separately provide a dedicated drive mechanism for operating the shielding portions 41Y, 41M, and 41C for shielding the openings 34Y, 34M, and 34C. Therefore, the space for the main body of the image forming apparatus A can be reduced, and the cost can be reduced.

Note that, during monochrome printing illustrated in FIG. 4, the cooling air 35 flowing to the peripheries of the respective process cartridges 9Y, 9M, and 9C of yellow (Y), magenta (M), and cyan (C) is completely blocked by the shielding portions 41Y, 41M, and 41C. Alternatively, the cooling air 35 may be caused to flow to the peripheries of the respective process cartridges 9Y, 9M, and 9C of yellow (Y), magenta (M), and cyan (C) to some degree with a slight opening area (gap between the opening 34 and the corresponding shielding portion 41) left without completely shielding the openings 34Y, 34M, and 34C by the shielding portions 41Y, 41M, and 41C. That is, it is appropriate that the cooling air 35 can be caused to flow concentratedly to a specific process cartridge 9 by changing the size of a gap between the opening 34 and the corresponding shielding portion 41, which is a shielding degree of the openings 34Y, 34M, 34C, and 34B, in accordance with the position of each developing unit 16 (including the case where the opening 34 is not shielded) to change an air flow resistance. More specifically, it is appropriate that the gap between the opening 34 and the corresponding shielding portion 41 when the developing roller 5 is disposed at a position separated from the photosensitive drum 1 is smaller than that when the developing roller 5 is disposed at a position in contact with the photosensitive drum 1.

Further, as a factor for generating heat in the process cartridge 9, there is given rubbing between the photosensitive drum 1 and the developing roller 5 besides the cleaning blade 7. From the viewpoint of causing the cooling air 35 to flow so as to suppress the heat generated by the rubbing between the photosensitive drum 1 and the developing roller 5, the effect of cooling the process cartridge 9B efficiently during monochrome printing is obtained as long as the openings 34Y, 34M, and 34C are shielded in larger area during monochrome printing than during color printing, irrespective of whether the photosensitive drums 1Y, 1M, and 1C rotate during monochrome printing. Further, the process cartridge 9 may be cooled by drawing air on the periphery of each process cartridge 9 through each opening 34 instead of blowing an air stream generated by the cooling fan 32 to each process cartridge 9 through the air flow duct 33. The similar effects are obtained even with the above-mentioned configuration. That is, the similar effects are obtained as long as the process cartridge 9 is cooled by causing air to flow through the opening 34.

Second Embodiment

Figure 6:
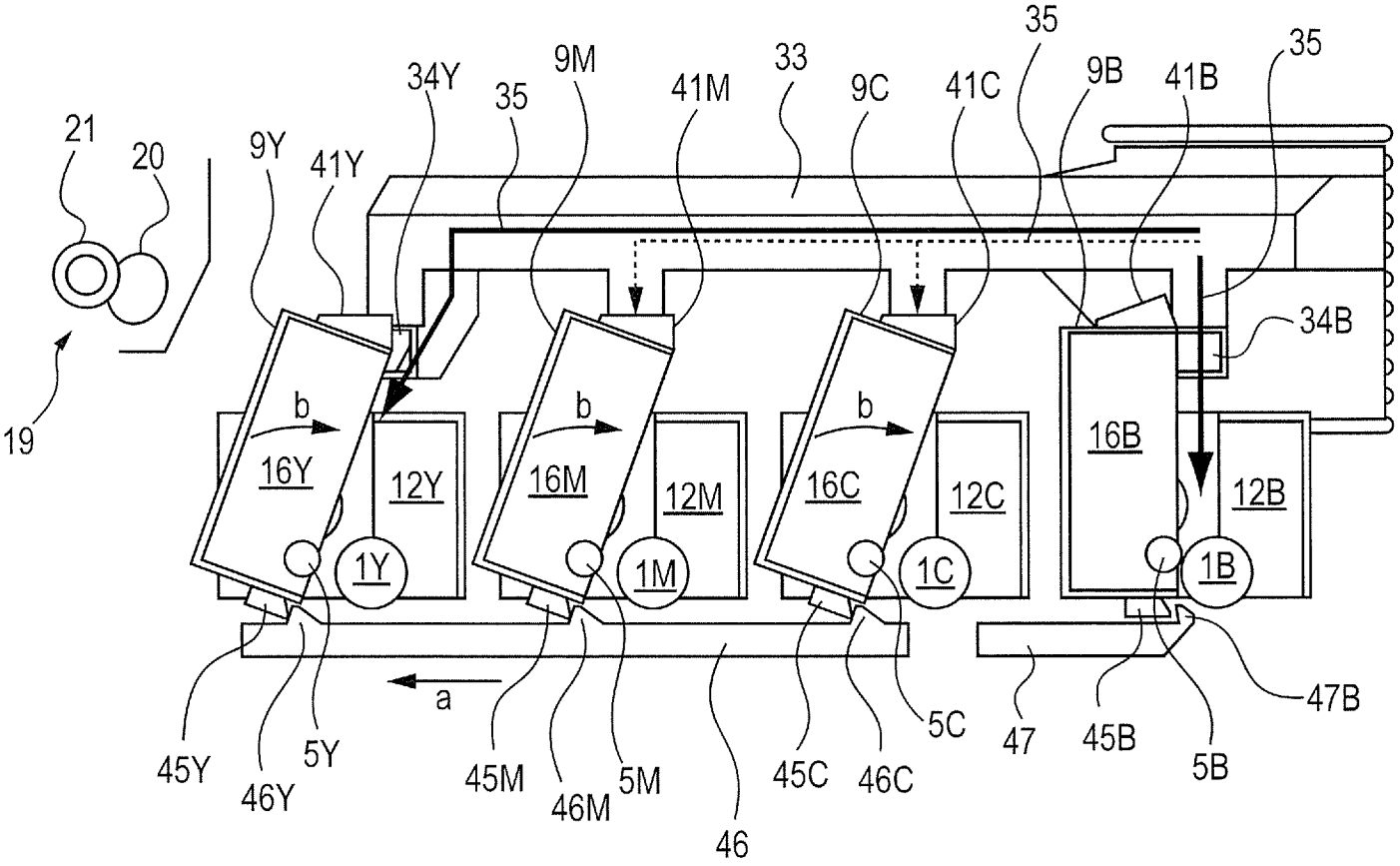
FIG. 6 is an explanatory sectional view illustrating a path of cooling air during monochrome printing in an image forming apparatus according to a second embodiment of the present invention.

Next, a configuration of an image forming apparatus according to a second embodiment of the present invention is described with reference to FIG. 6. FIG. 6 is an explanatory sectional view illustrating a configuration of a cooling portion during monochrome printing in the second embodiment. Note that, components having the same configurations as those of the first embodiment are denoted with the same reference symbols as those therein, and the descriptions thereof are omitted.

In the first embodiment, the cooling air 35 flowing to the peripheries of the respective process cartridges 9Y, 9M, and 9C of yellow (Y), magenta (M), and cyan (C) are completely blocked by the shielding portions 41Y, 41M, and 41C during monochrome printing illustrated in FIG. 4. Then, the cooling air 35 is caused to flow concentratedly from the cooling fan 32 to the periphery of the process cartridge 9B of black (B).

In the second embodiment, the cooling air 35 flowing to the peripheries of the respective process cartridges 9M and 9C (first cartridges) of magenta (M) and cyan (C) is completely blocked by the shielding portions 41M and 41C during monochrome printing illustrated in FIG. 6. However, the cooling air 35 flowing to the periphery of the process cartridge 9Y (second cartridge) of yellow (Y) closest to the fixing device 19 that acts as a heat-generation source is blocked by shielding only part of the opening 34Y. Further, the cooling air 35 is caused to flow concentratedly from the cooling fan 32 to the periphery of the process cartridge 9B of black (B).

As illustrated in FIG. 6, the process cartridge 9Y of yellow (Y) according to the second embodiment is disposed so as to be closest to the fixing film 20 that acts as a heat-generation source. Therefore, in the configuration of the cooling portion of the second embodiment, about half of the opening 34Y disposed in the vicinity of the process cartridge 9Y of yellow (Y) is shielded by the shielding portion 41Y during monochrome printing.

That is, in the second embodiment, the process cartridges other than the process cartridge 9B of black (B) to be used during monochrome printing are considered. Then, a second opening area of the opening 34Y to be shielded by the shielding portion 41Y of the process cartridge 9Y of yellow (Y) on the side close to the fixing device 19 is considered. Further, a first opening area of the openings 34M and 34C to be shielded by the shielding portions 41M and 41C of the respective process cartridges 9M and 9C of magenta (M) and cyan (C) on the side farther from the fixing device 19 is considered. Then, the second opening area is set to be larger than the first opening area.

That is, the opening area of the opening 34Y on the side of the process cartridge 9Y of yellow (Y) is larger than the opening area (=0) of the openings 34M and 34C on the side of the respective process cartridges 9M and 9C of magenta (M) and cyan (C).

As illustrated in FIG. 6, during monochrome printing, the openings 34M and 34C corresponding to the respective process cartridges 9M and 9C of magenta (M) and cyan (C) on the side farther from the fixing device 19 are completely shielded by the shielding portions 41M and 41C. Further, about half of the opening 34Y corresponding to the process cartridge 9Y of yellow (Y) on the side closest to the fixing device 19 is shielded by the shielding portion 41Y.

The opening 34B corresponding to the process cartridge 9B of black (B) remains fully opened with the shielding portion 41B retracting from the opening 34B. As a result, the cooling air 35 flowing from the air flow duct 33 is dispersed to the openings 34B and 34Y and blown to the peripheries of the photosensitive drums 1Y and 1B of the process cartridge 9Y of yellow (Y) and the process cartridge 9B of black (B). In this case, the air amount of the cooling air 35 to the process cartridge 9Y of yellow (Y) is smaller than that of the cooling air 35 to the process cartridge 9B of black (B).

In the case of using the configuration of the cooling portion of the second embodiment, the cooling air 35 can be caused to flow concentratedly to the process cartridge 9B of black (B) during monochrome printing, and further, the cooling air 35 can also be caused to flow to the process cartridge 9Y of yellow (Y) disposed in the vicinity of the fixing device 19. As a result, the r.p.m. of the cooling fan 32 during monochrome printing can be reduced, and simultaneously an increase in temperature on the periphery of the process cartridge 9Y of yellow (Y), which is caused by the heat generated by the fixing device 19, can be suppressed.

In the second embodiment, about half of the opening 34Y corresponding to the process cartridge 9Y of yellow (Y) is shielded. Alternatively, the opening 34 corresponding to the process cartridge 9 of another color may be shielded with a predetermined opening area left, as long as the process cartridge 9 of another color is disposed in the vicinity of the fixing device 19. The remaining configuration is the same as that of the first embodiment, and the same effects as those of the first embodiment can be obtained.

Third Embodiment

Next, a configuration of an image forming apparatus according to a third embodiment of the present invention is described with reference to FIGS. 7 and 8. Note that, components having the same configurations as those of the embodiments described above are denoted with the same reference symbols as those therein, and the descriptions thereof are omitted.

Figure 7:
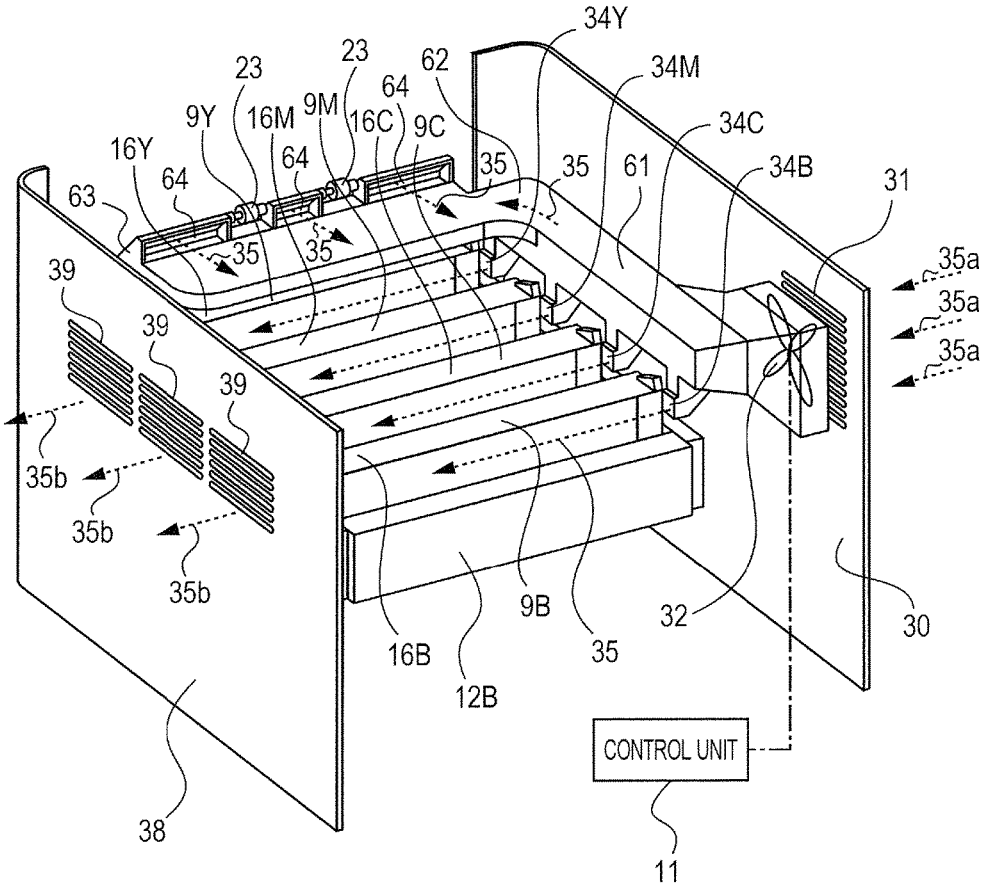
FIG. 7 is an explanatory perspective view illustrating a path of cooling air during color printing in an image forming apparatus according to a third embodiment of the present invention.

FIG. 7 is an explanatory perspective view illustrating a configuration of a cooling portion in the third embodiment. FIG. 8 is an explanatory sectional view illustrating a configuration of the cooling portion during rotation after printing in the third embodiment.

In the embodiments described above, the periphery of the process cartridge 9 is cooled. In the third embodiment, the periphery of each process cartridge 9 is cooled during printing, and during rotation after printing, a toner image is fixed in the fixing device 19, and the recording material P discharged onto the discharging tray 24 by the discharging roller 22 is cooled.

Figure 8:
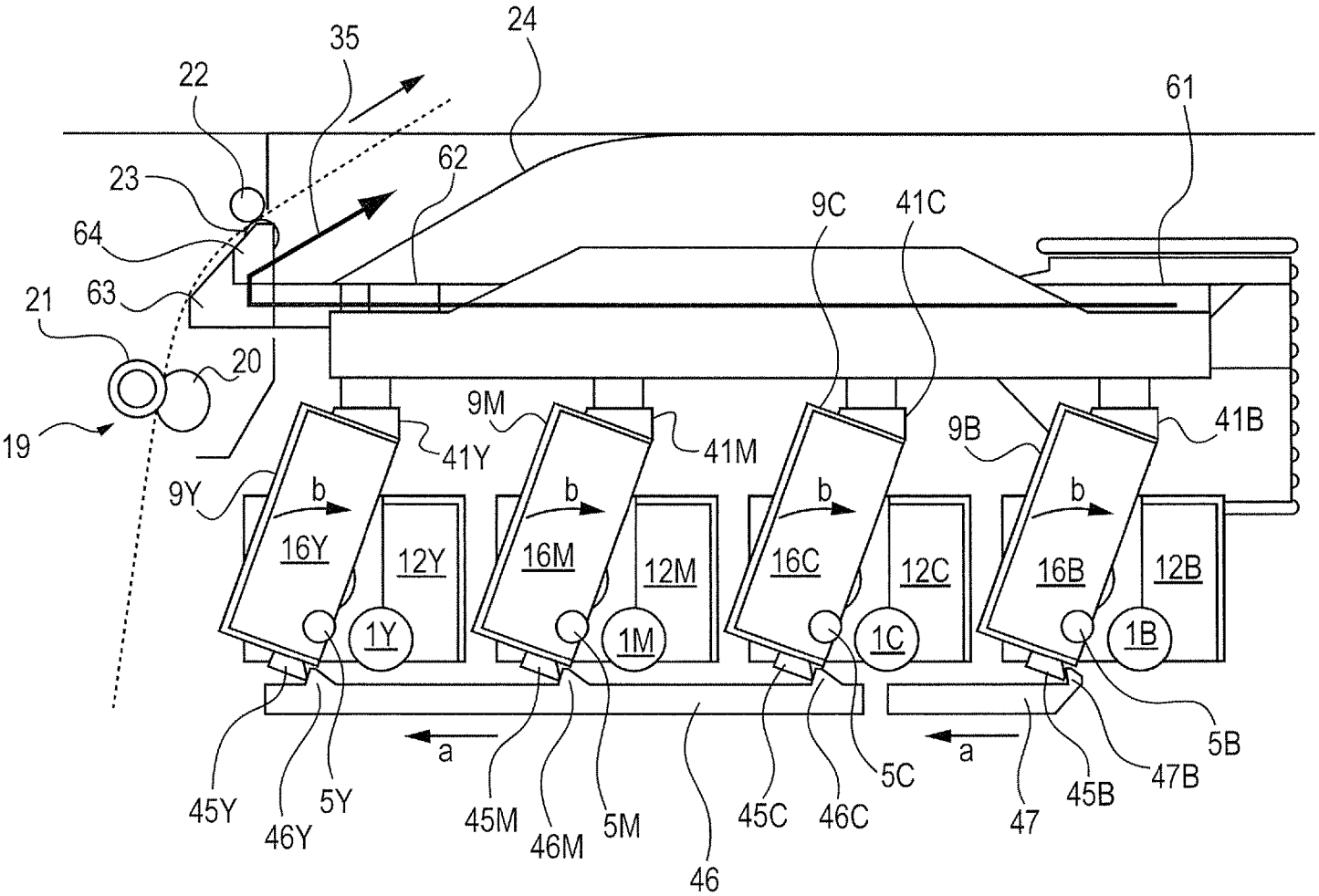
FIG. 8 is an explanatory sectional view illustrating a path of cooling air during rotation after a printing operation in the third embodiment of the present invention.

As illustrated in FIGS. 7 and 8, in the configuration of the cooling portion of the third embodiment, second openings 64 are provided in an air flow duct 61 connected to the cooling fan 32 separately from the openings 34Y, 34M, 34C, and 34B corresponding to the respective process cartridges 9Y, 9M, 9C, and 9B.

There is provided a branch duct 62 for causing the cooling air 35 to flow to the discharging guide 63 serving as a discharging unit for discharging the recording material P outside at downstream of the fixing device 19 of the image forming apparatus in the recording material conveyance direction. The discharging guide 63 includes the second openings 64 through which the cooling air 35 is caused to flow to the discharging tray 24 serving as a discharging unit.

The air 35*a* drawn from outside of the main body of the image forming apparatus A through the inlet louver 31 by the cooling fan 32, which is controlled to rotate by the control unit 11, passes through the air flow duct 61 as the cooling air 35. Then, there are first flow paths extending to the openings 34Y, 34M, 34C, and 34B arranged to be opposed to the ends on one side in the longitudinal direction of the respective process cartridges 9Y, 9M, 9C, and 9B. Further, there is a second flow path extending to the branch duct 62 connected to the discharging guide 63 including the second openings 64. The cooling air 35 is caused to flow while being branched into the first flow paths and the second flow path.

The cooling air 35 caused to flow from each opening 34 flows in the longitudinal direction from one end to the other end in the longitudinal direction of the photosensitive drum 1 in the process cartridge 9 to cool the periphery of the photosensitive drum 1. Then, the air 35*b* having passed through the other end of the process cartridge 9 is discharged outside of the main body of the image forming apparatus A through the outlet louver 39.

On the other hand, the cooling air 35 caused to flow through the second openings 64 is discharged outside of the main body of the image forming apparatus A to cool the peripheries of the discharging guide 63 and the discharging tray 24.

As illustrated in FIG. 8, during rotation after printing, the separating lever 46 for color printing and the separating lever 47 for monochrome printing are moved in a direction of an arrow "a" of FIG. 8 by the movement means including the cam mechanism (not shown) and the like.

In this case, the engagement portions 46Y, 46M, 46C, and 47B provided at the separating levers 46 and 47 are engaged with the engagement portions 45Y, 45M, 45C, and 45B of the respective developing units 16Y, 16M, 16C, and 16B. Then, the respective developing units 16Y, 16M, 16C, and 16B are rotated in a direction of an arrow "b" of FIG. 8 about the rotation center (not shown) thereof.

As a result, the photosensitive drum 1 and the developing roller 5 of the process cartridge 9 are caused to separate from each other. In synchronization with the separating operation, the shielding portions 41Y, 41M, 41C, and 41B provided at the respective developing units 16Y, 16M, 16C, and 16B completely shield the openings 34Y, 34M, 34C, and 34B.

Thus, during rotation after printing, as illustrated in FIG. 8, the cooling air 35 flowing through the air flow duct 61 is concentrated in the branch duct 62 connected to the discharging guide 63. Consequently, the cooling air 35 can be concentratedly blown to the peripheries of the discharging guide 63 and the discharging tray 24, and thereby the cooling air 35 can cool the recording material P which is conveyed under the condition of being nipped between the discharging roller 22 and the rotary discharging member 23 while being guided by the discharging guide 63 and is discharged onto the discharging tray 24.

In the case of using the configuration of the cooling portion of the third embodiment, as illustrated in FIG. 7, the cooling air 35 is caused to flow to each process cartridge 9 with each opening 34 unshielded during color printing and monochrome printing. Further, the cooling air 35 can also be caused to flow to the peripheries of the discharging guide 63 and the discharging tray 24 through the second openings 64. In addition, during rotation after printing, as illustrated in FIG. 8, the peripheries of the discharging guide 63 and the discharging tray 24 can be concentratedly cooled with each opening 34 being completely closed by each shielding portion 41.

That is, the developing unit 16 rotates in synchronization with the operations of the separating levers 46 and 47 serving as the contacting/separating means. Then, the air amount of the cooling air 35 caused to flow to the peripheries of the discharging guide 63 and the discharging tray 24 serving as the discharging units through the second openings 64 can be adjusted through the operation of shielding or unshielding the opening 34 by the shielding portion 41 provided at the developing unit 16.

Under severe conditions such as image formation in a high-temperature environment and continuous image formation of forming a great amount of images at a time, a toner of the recording materials P stacked on the discharging tray 24 is melted, and thereby the recording materials P stick to each other to damage the image in some cases. However, if the configuration of the cooling portion of the third embodiment is used, the temperature on the peripheries of the discharging guide 63 and the discharging tray 24 can be kept at a predetermined level or less. The remaining configuration is the same as those of the embodiments described above, and the same effects as those of the embodiments described above can be obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-253823, filed Nov. 20, 2012, and No. 2013-233596, filed Nov. 12, 2103, which are hereby incorporated by reference herein in their entirety.

What is claimed is:

1. An image forming apparatus comprising:

a first cartridge including a first photosensitive drum on which a latent image is formed and a first developing member to supply toner to the latent image formed on the first photosensitive drum;

a second cartridge including a second photosensitive drum on which a latent image is formed and a second developing member to supply toner to the latent image formed on the first photosensitive drum;

a cooling device configured to supply air;

a duct configured to introduce the air supplied from the cooling device to the first cartridge and the second cartridge, the duct including a first opening whose position corresponds to a position of the first cartridge and a second opening whose position corresponds to a position of the second cartridge;

wherein the first cartridge includes a movable first shielding member that is configured to shield the first opening, and the second cartridge includes a movable second shielding member that is configured to shield the second opening, a first contacting/separating unit movable to separate the first developing member from the first photosensitive drum and to separate the second developing member from the second photosensitive drum, and wherein a shielding amount in which the first shielding member shields the first opening in an axis direction along an axis of the first photosensitive drum is less than a shielding amount in which the second shielding member shields the second opening in the axis direction.

2. An image forming apparatus according to claim 1, wherein the first contacting/separating unit includes a separating lever having a first engaged portion configured to engage a first engagement portion of the first cartridge and a second engaged portion configured to engage a second engagement portion of the second cartridge.

3. An image forming apparatus according to claim 2, wherein the separation lever extends along a line of the first cartridge and the second cartridge, the separation lever being contactable to and separable from both the first cartridge and the second cartridge, wherein the separation lever moves in a direction along the line to move the first developing member and the movable first shielding member with regard to the first photosensitive drum and moves the second developing member and the movable second shielding member with regard to the second photosensitive drum.

4. An image forming apparatus according to claim 3, wherein the first developing member separates from the first photosensitive drum according to movement of the separating lever to shield the first opening with the movable first shielding member, and the second developing member separates from the second photosensitive drum member according to movement of the separating lever to shield the second opening with the movable second shielding member.

5. An image forming apparatus according to claim 4, further comprising a third cartridge including a third photosensitive drum on which a latent image is formed and a third developing member supplying toner to the latent image formed on the third photosensitive drum, wherein the duct includes a third opening whose position corresponds to a position of the third cartridge.

6. An image forming apparatus according to claim 5, wherein the third cartridge includes a movable third shielding member that is configured to shield the third opening; and a second contacting/separating unit movable to separate the third developing member from the third photosensitive drum, with the second contacting/separating unit being different from the first contacting/separating unit, wherein the movable third shielding member moves according to movement of the second contacting/separating unit.

7. An image forming apparatus according to claim 1, further comprising a fixing device for fixing, on a recording material, a transferred toner image by heating the recording material.

8. An image forming apparatus according to claim 7, wherein the first cartridge is positioned on a side on which the fixing device is nearer than the second cartridge.

* * * * *